US007243450B2

(12) United States Patent
Dicke et al.

(10) Patent No.: US 7,243,450 B2
(45) Date of Patent: Jul. 17, 2007

(54) SIGN STAND HAVING RESILIENT BASE

(75) Inventors: Grant D. Dicke, Downers Grove, IL (US); James G. Kokenes, Westmont, IL (US); Jeffrey A. Williams, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 509 days.

(21) Appl. No.: 10/914,349

(22) Filed: Aug. 9, 2004

(65) Prior Publication Data

US 2006/0026877 A1 Feb. 9, 2006

(51) Int. Cl.
*G09F 15/00* (2006.01)

(52) U.S. Cl. ..... 40/607.1; 40/607.01; 248/167; 248/188.7

(58) Field of Classification Search ..... 40/606.01, 40/607.01, 607.04, 607.1; 404/9; 116/63 P, 116/63 R; 248/166, 167, 434, 435, 439, 248/188.6, 188.7
See application file for complete search history.

(56) References Cited

U.S. PATENT DOCUMENTS

| | | | | |
|---|---|---|---|---|
| 2,625,130 | A | 1/1953 | Morser | |
| 2,735,702 | A * | 2/1956 | Larson | 403/61 |
| 2,887,983 | A | 5/1959 | Budd | |
| 3,099,244 | A | 7/1963 | Knapp | |
| 3,119,588 | A | 1/1964 | Keats | |
| 3,235,214 | A | 2/1966 | Sprung | |
| 3,287,840 | A | 11/1966 | Keats | |
| 3,415,475 | A | 12/1968 | Goodman | |
| 3,851,616 | A | 12/1974 | Brown | |
| 4,019,271 | A | 4/1977 | Latimer | |
| 4,090,465 | A | 5/1978 | Bell, Sr. | |
| 4,099,771 | A | 7/1978 | Mathews | |
| 4,201,975 | A | 5/1980 | Marcus | |
| 4,273,213 | A | 6/1981 | Munz | |
| 4,318,238 | A | 3/1982 | Macarle, Jr. | |
| 4,411,085 | A | 10/1983 | Farmer | |
| 4,611,949 | A | 9/1986 | Schmanski | |
| 4,645,168 | A | 2/1987 | Beard | |
| 4,718,624 | A | 1/1988 | Greulich | |
| 4,864,299 | A | 9/1989 | Kuhl | |
| 4,889,067 | A | 12/1989 | Provence, Jr. | |
| 5,088,680 | A | 2/1992 | Farmer | |
| 5,165,818 | A | 11/1992 | Newhart | |
| D331,605 | S | 12/1992 | Brydalski et al. | |
| 5,168,827 | A | 12/1992 | Junker | |
| 5,220,740 | A | 6/1993 | Brault | |

(Continued)

FOREIGN PATENT DOCUMENTS

| | | |
|---|---|---|
| GB | 709068 | 2/1958 |

(Continued)

*Primary Examiner*—Joanne Silbermann
(74) *Attorney, Agent, or Firm*—Olson & Hierl, Ltd.

(57) ABSTRACT

A base is provided for use with warning signs and the like. A metal structural framework is fitted to the underside of an elastomeric body in the form of a monolithic slab. Forces from the sign panel are transmitted through the structural framework, which includes a plurality of outwardly radiating legs. Forces are transmitted to the ends of the legs, which preferably are fitted with outwardly extending feet. Force loadings are transmitted through the structural framework rather than the elastomeric body, which provide a ballast for the structural framework.

20 Claims, 9 Drawing Sheets

U.S. PATENT DOCUMENTS 5,267,523 A 12/1993 Hugron
D346,623 S 5/1994 Brydalski et al.
D352,527 S 11/1994 Byrdalski et al.
5,451,118 A 9/1995 Wilkins et al.
5,483,917 A 1/1996 Walker
5,484,225 A 1/1996 Warner
5,611,507 A * 3/1997 Smith ..... 248/99
5,630,675 A 5/1997 Boeger
5,670,954 A 9/1997 Junker
5,676,350 A 10/1997 Galli et al.
5,713,694 A 2/1998 Monda et al.
D392,686 S 3/1998 Sarkisian et al.
5,732,911 A 3/1998 Kulp et al.
5,738,317 A 4/1998 Hugron
5,755,528 A 5/1998 Kulp et al.
5,775,833 A * 7/1998 Little ..... 404/9
5,788,405 A 8/1998 Beard
5,795,530 A 8/1998 Monda et al.
5,860,386 A 1/1999 Schwab et al.
5,875,578 A 3/1999 Grewe
5,878,518 A 3/1999 Grewe
6,032,908 A 3/2000 Hillstrom et al.
6,053,658 A 4/2000 Gibson, Jr.
6,115,951 A 9/2000 Jing et al.
6,186,699 B1 2/2001 Kulp et al.
6,315,251 B1 11/2001 Stoudt et al.
6,569,510 B1 5/2003 Menon et al.
6,626,410 B2 9/2003 Marcotte et al.
6,659,681 B1 12/2003 Kulp et al.

FOREIGN PATENT DOCUMENTS

GB 1117283 6/1968
GB 2125863 A * 3/1984
GB 2159197 A * 11/1985

* cited by examiner

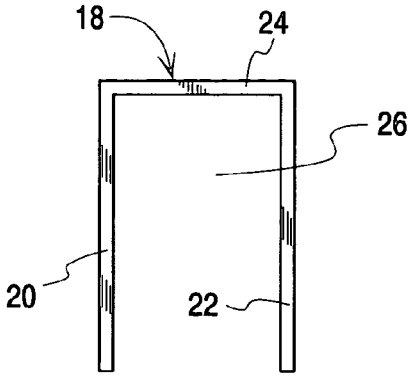
Fig. 10
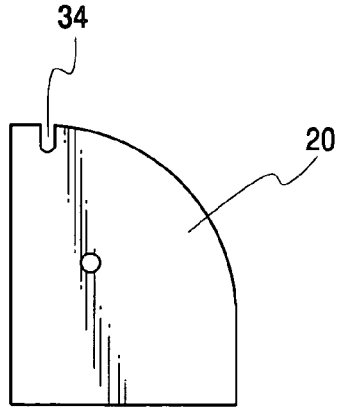
Fig. 11
Fig. 19
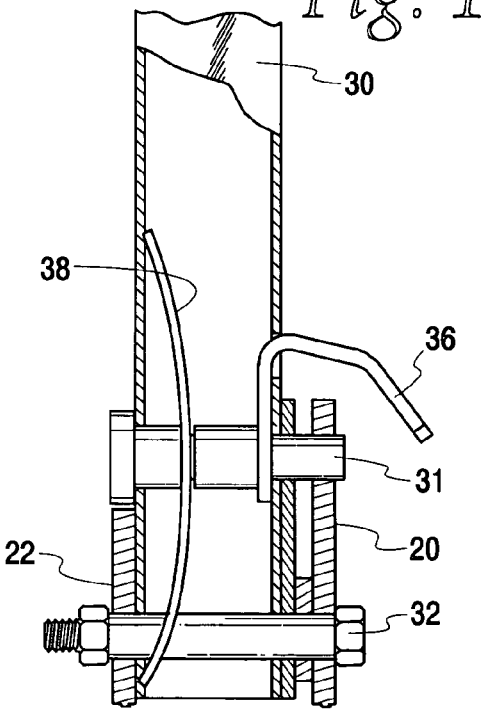
Fig. 13
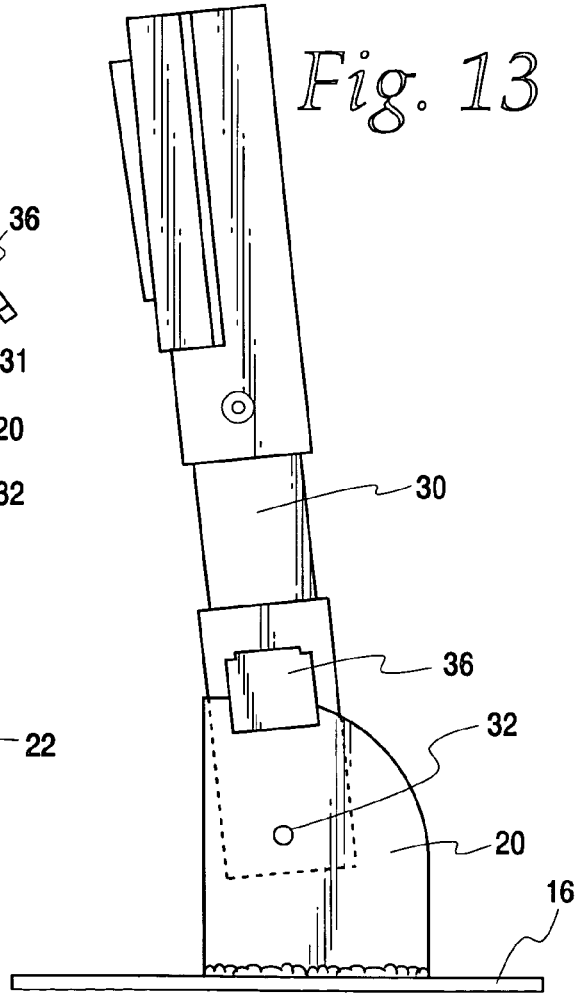
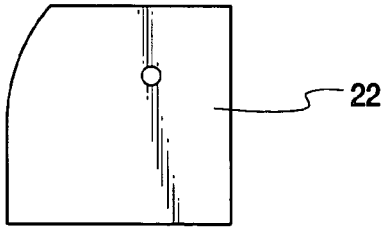
Fig. 12

SIGN STAND HAVING RESILIENT BASE

BACKGROUND OF THE INVENTION

1. Field of the Invention

The present invention pertains to sign stands and in particular to portable sign stands which can be erected and used during the course of a work day and thereafter disassembled for storage.

2. Description of the Related Art

Roadway signage is required to provide warnings for pedestrians and motorists that a work site is in operation. A growing need has arisen for signage which can be stored in a work vehicle and employed on demand, as required. Such signage may be used, for example, by emergency work crews, to set up a safety perimeter around a work area. In addition, many regularly scheduled jobs continually move along a roadway requiring the signage to be relocated along with progress of the work crews. A variety of collapsible sign stands have been provided for this purpose. Such sign stands have typically included rigid elongated members of light weight metallic channels and tubes fastened together to form an upright and a number of collapsible ground-contacting legs to support the upright in a vertical position. Over the years, advances have been made to adapt some sign assemblies to form a single elongated package, suitable for economical storage in a work vehicle.

One challenge to light weight roadway signage is the ability of the signage to withstand wind loads caused by atmospheric and vehicular sources. Temporary signage of the type contemplated by the present invention is usually provided in as lightweight a form as possible, given the requirements that the signage be quickly and easily erected on demand, and subsequently disassembled and stored during the course of the same workday. With relatively large sign panels mounted atop the upright or mast unusually high wind loads may cause the sign stand to tip over, and efforts are made to increase the stability of lightweight portable sign stand bases.

SUMMARY OF THE INVENTION

It is an object of the present invention to provide a portable lightweight base for sign stands and the like.

Another object of the present invention is to provide a sign stand base which is stable against wind loadings and other disturbances.

A further object of the present invention is to provide a lightweight sign stand which can readily be erected and thereafter reconfigured for storage in a work vehicle or the like.

Yet another object of the present invention is to provide a lightweight sign stand base utilizing resilient components.

These and other objects according to principles of the present invention are provided in a sign stand base comprising a plate; an adapter member upstanding from said plate, with a mast joinder for joining to a sign mast; a plurality of legs outwardly radiating from said plate in generally horizontal directions and having free ends remote from said plate; a resilient body of resilient material defining an aperture for receiving said adapter member and said plate, and a plurality of recessed channels for receiving said plurality of legs; and rigid connections rigidly connecting said adapter member to said plate, said plate to said plurality of legs, and said plurality of legs to said resilient body. The aperture is dimensioned to form a gap between said resilient body and said plate and said adapter member, so that forces applied to said adapter member are transmitted through said plate to the free ends of said legs.

Other objects according to principles of the present invention are provided in a sign stand assembly comprising a sign panel; a sign mast supporting said sign panel and having a free end; a plate; an adapter member upstanding from said plate, with a mast joinder for joining to said sign mast; a plurality of legs outwardly radiating from said plate in generally horizontal directions and having free ends remote from said plate; a resilient body of resilient material defining an aperture for receiving said adapter member and said plate, and a plurality of recessed channels for receiving said plurality of legs; and rigid connections rigidly connecting said adapter member to said plate, said plate to said plurality of legs, and said plurality of legs to said resilient body. The aperture is dimensioned to form a gap between said resilient body and said plate and said adapter member, so that forces applied to said adapter member are transmitted through said plate to the free ends of said legs.

BRIEF DESCRIPTION OF THE DRAWINGS

FIG. 10 is a top plan view of a mounting bracket;

FIG. 11 is a view from one side thereof;

FIG. 12 is a view from the other side thereof;

FIG. 13 is a fragmentary side elevation view showing the mounting adapter in an over travel position;

FIG. 19 is a cross-sectional view taken along the line 19-19 of FIG. 2.

DETAILED DESCRIPTION OF THE PREFERRED EMBODIMENTS

Figure 1:
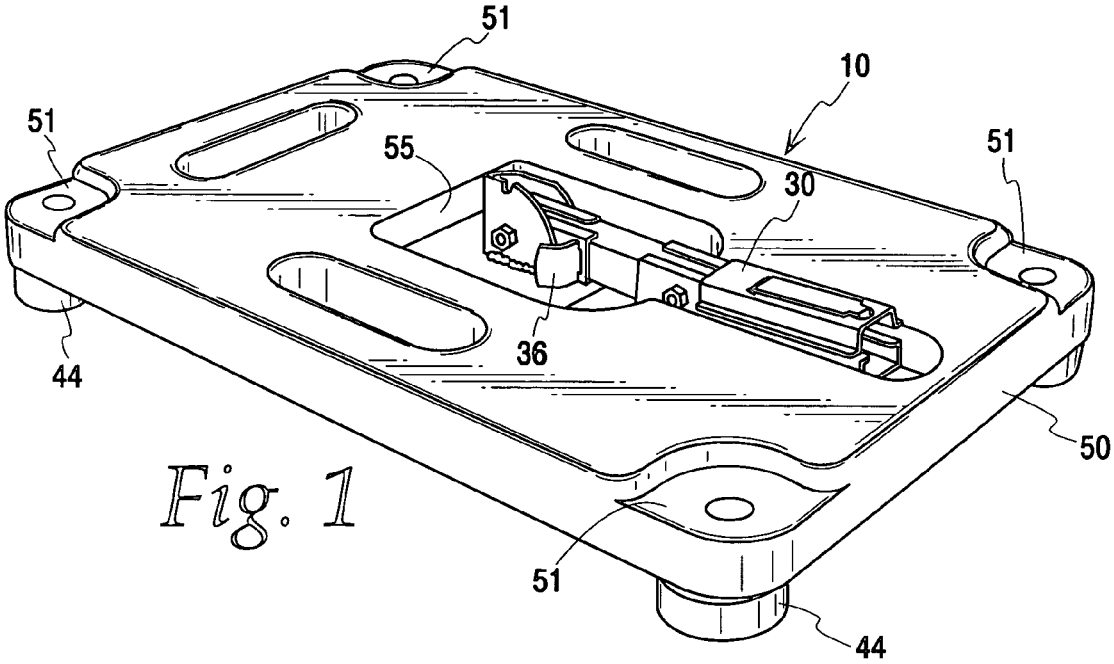
FIG. 1 is a perspective view of a sign stand base with a mounting adapter in a retracted position.
Figure 2:
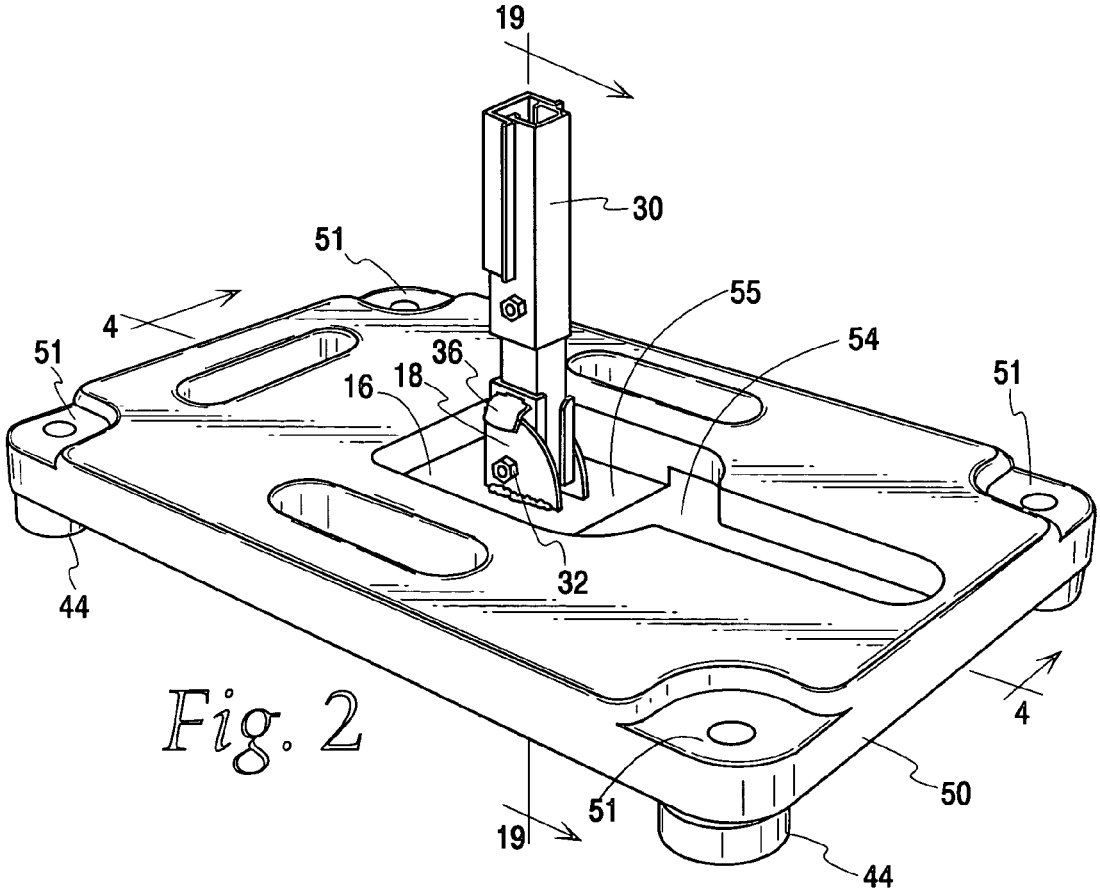
FIG. 2 is a perspective view thereof with the mounting adapter in an upright position.
Figure 3:
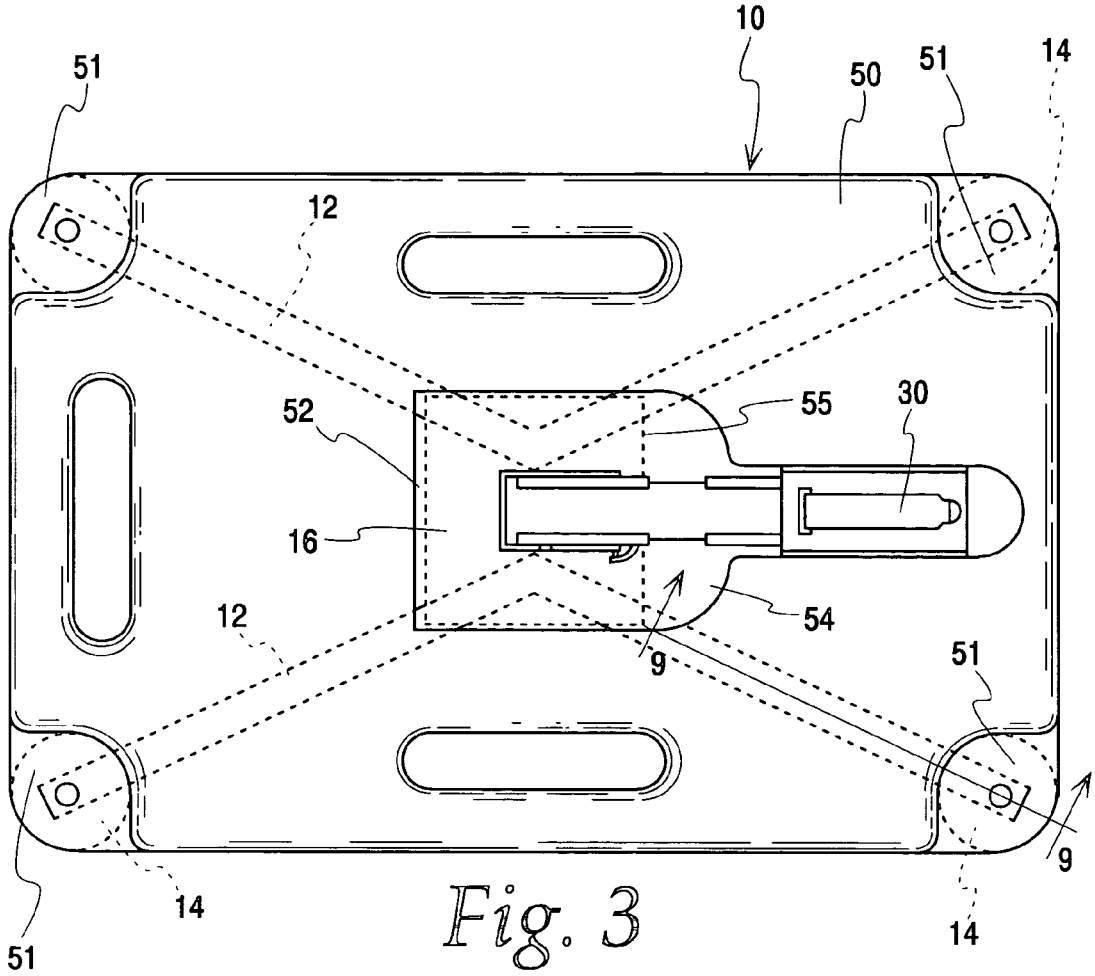
FIG. 3 is a top plan view thereof.

Turning now to the drawings, a sign stand base according to principles of the present invention is generally indicated at 10 in FIGS. 1-3. As will be seen herein, sign stand base 10 is preferably constructed by joining a rubber base 50, shown in FIGS. 8 and 15 and an internal metal framework subassembly 11 shown in FIG. 16. An adapter 30 is mounted to framework 11 and is pivotally movable between a collapsed storage position shown in FIG. 1, and an upright or operational position shown in FIG. 2. Further, adapter 30 is movable to an over-travel position, past the vertical or operational position, as shown in FIG. 13. At its upper end, mast joinder or adapter 30 includes a receptacle or central opening for receiving a sign mast (as shown, for example, at the top of FIG. 4), made of aluminum tubing or other conventional construction, to provide joinder for the mast to the internal subassembly.

Referring to FIG. 2, adapter 30 is pivotally mounted to a fitting 18, generally resembling a U-shaped bracket, which is welded or otherwise rigidly joined to a metal plate 16. Referring to FIGS. 10-12 fitting 18 has three sidewalls formed by side plates 20, 22 and an end plate 24. Side plates 20-22 and end plate 24 cooperate to form an opening 26 for receiving the lower end of adapter 30. As shown for example in FIG. 2, a pivot pin 32 preferably comprising a bolt fastener pivotally secures adapter 30 to bracket 18. Referring to FIG. 11, plate 20 includes a notch 34 which receives a locking pin 31 associated with the bottom end of adapter 30. (see FIG. 19) Referring to FIGS. 2 and 19, a lever release 36 compresses spring 38 which releases the locking pin 31 from notch 34, allowing the adapter 30 to move to its retracted position indicated in FIG. 1. If sufficient force is applied to adapter 30 in an opposing direction, the locking pin 31 is forced out of notch 34, allowing adapter 30 to over travel away from the vertical operational position as indicated in FIG. 13 until the adapter contacts end wall 24 of bracket 18 (see FIG. 10).

Figure 4:
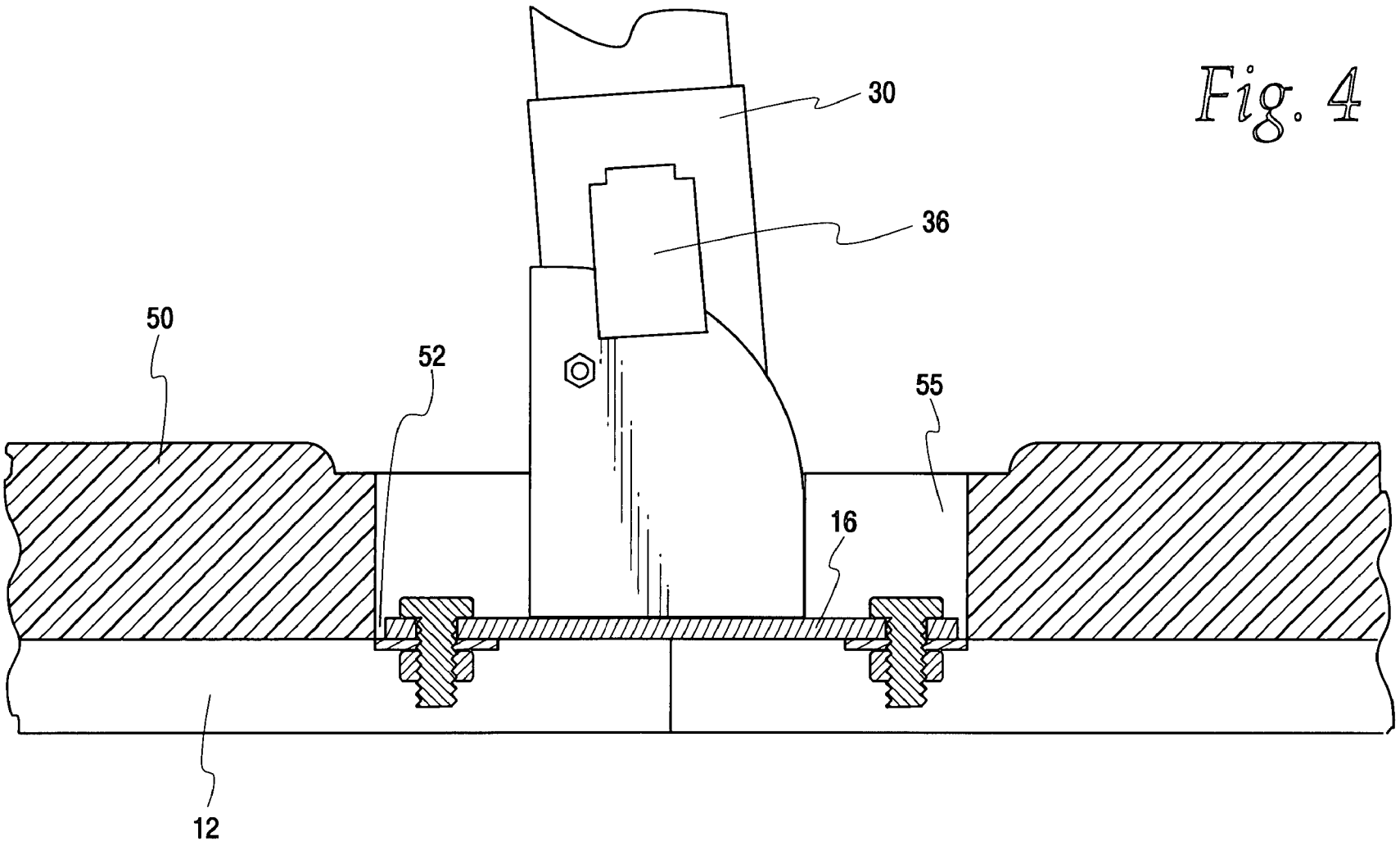
FIG. 4 is a fragmentary cross-sectional view taken along the line 4-4 of FIG. 1.

Referring again to FIG. 16, plate 16 is rigidly joined to leg pairs 12 by conventional joining means such as a metallurgical joinder (e.g. welding or brazing) or more preferably, by bolt fasteners as indicated in FIG. 4. Referring to FIG. 3, the leg pairs 12 are generally V-shaped and include individual legs extending to the corners of the sign stand base. In the preferred embodiment, leg pairs 12 are preferably formed of steel channels having an L-shaped cross section. The ends of the individual legs are rigidly joined together by welding or other conventional means to form the leg pairs 12.

Figure 8:
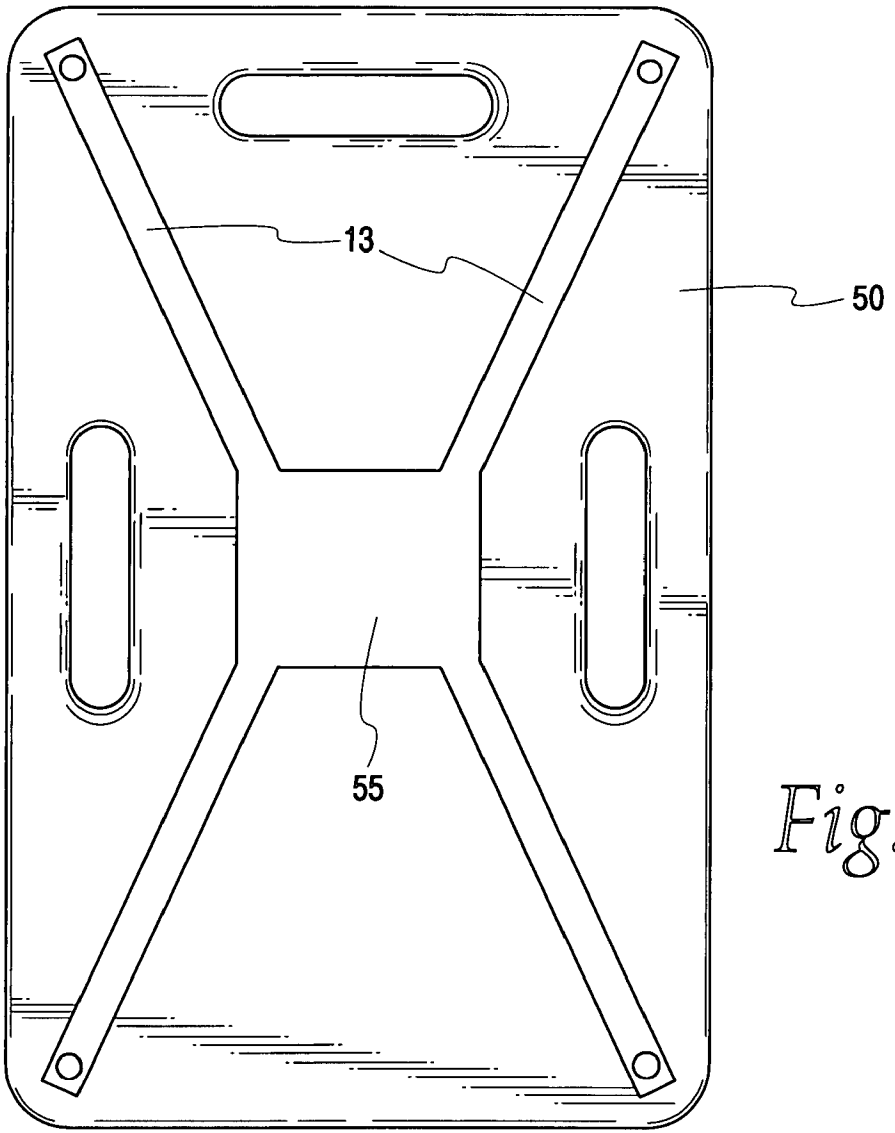
FIG. 8 is a bottom view of the rubber molding.
Figure 14:
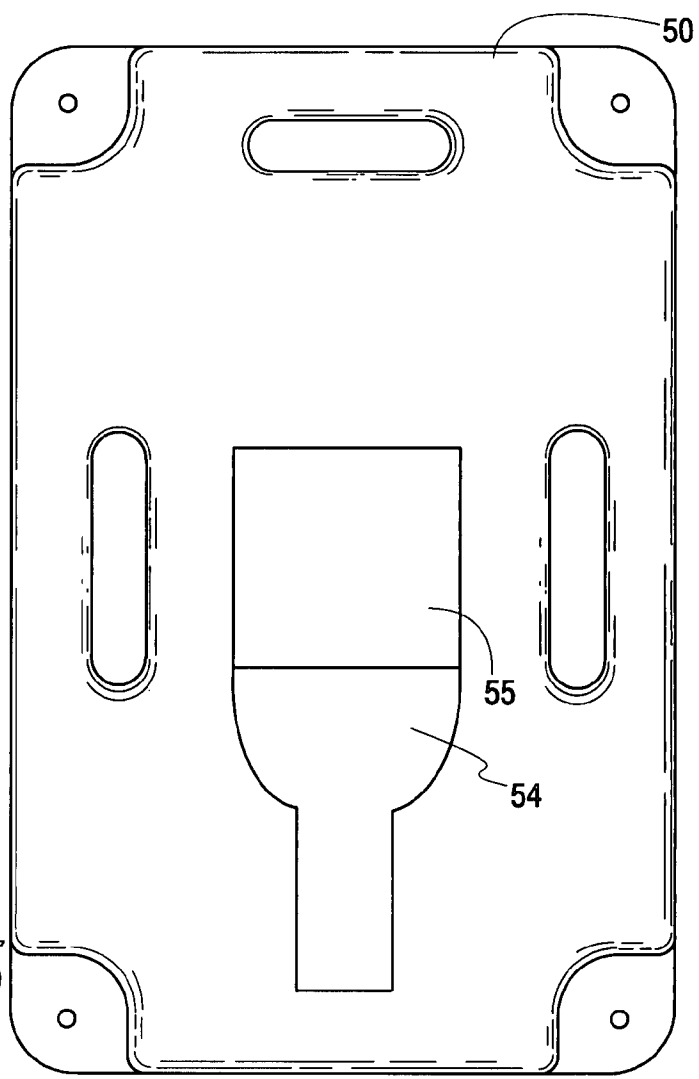
FIG. 14 is a bottom view of the sign stand base.

Plate 16 is bolted to the leg pairs to form the internal framework subassembly 11 (shown in FIG. 16) which in turn is joined to the rubber base shown for example in FIG. 8. Referring to FIG. 8, the underside of the elastomeric body 50 includes a central opening 55 and channel pockets or recesses 13 radiating to the corners. The internal framework 11 is fitted to the underside of elastomeric body 50 as indicated in FIG. 14, with plate 16 and adapter 30 being received in central hole 55 of the elastomeric body, and with the leg pairs 12 being received in the recesses or 13 of the elastomeric body 50 shown in FIG. 8. The joinder of the internal framework subassembly 11 and elastomeric body 50 is illustrated for example in FIGS. 4 and 5. Preferably, one or more bolt fasteners are inserted through the upper surface of elastomeric body 50, extending to the leg pairs 12. As can be seen for example in FIG. 14 plate 16 is sized slightly smaller than the central opening 55 in elastomeric body 50, thus creating a gap 52 between edges of plate 15 and the elastomeric body, in a manner which also spaces adapter 30 from the elastomeric body. As will be seen herein, this gap feature ensures that forces applied to the sign stand base are contained within the internal framework assembly, until transference at the corners of the base.

Figure 16:
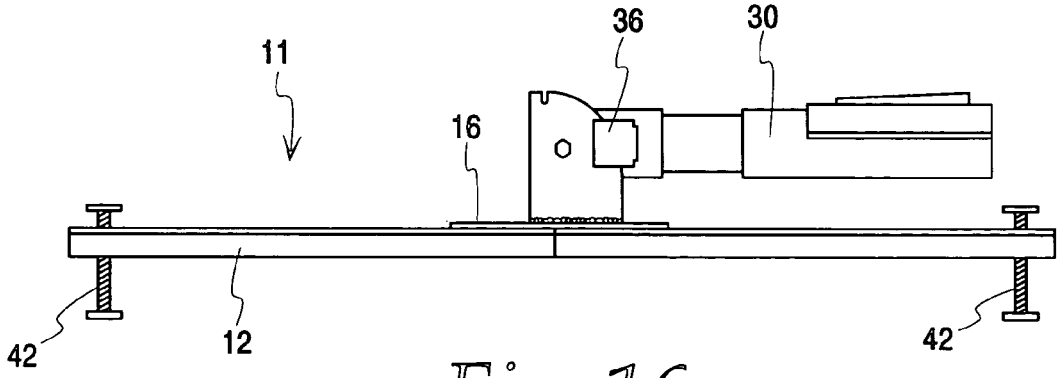
FIG. 16 is a side elevational view of the sign stand base with the rubber molding removed.
Figure 5:
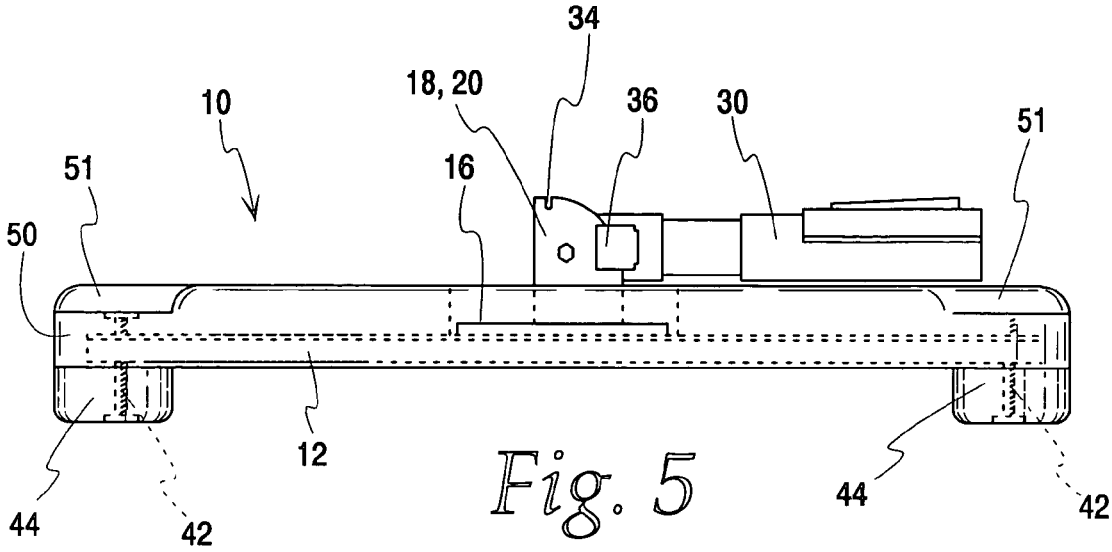
FIG. 5 is a side elevational view of the sign stand base.
Figure 6:
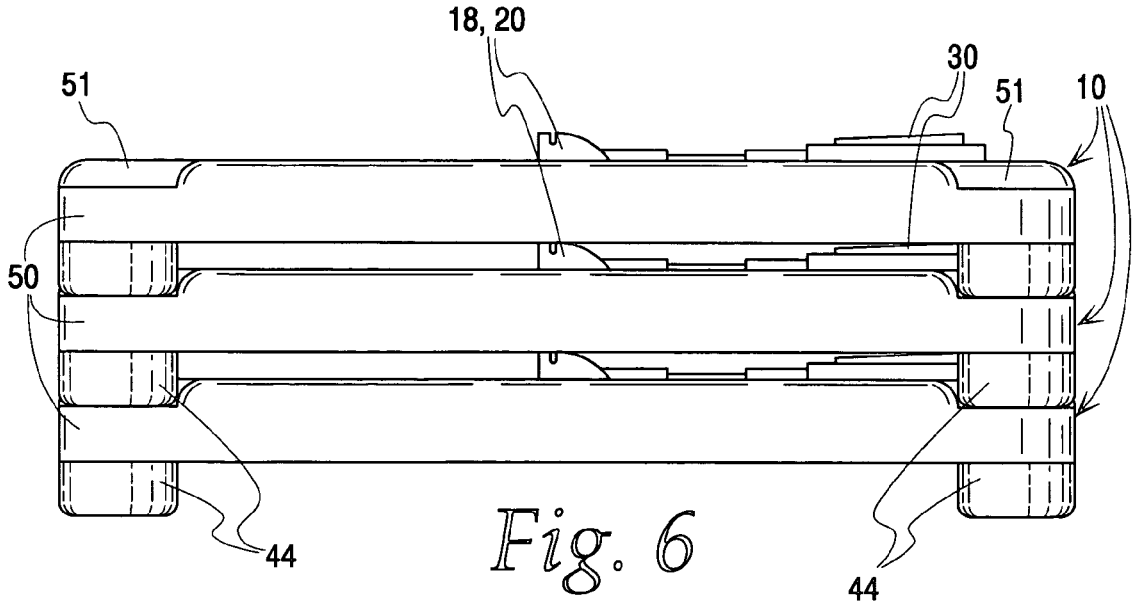
FIG. 6 is a side elevational view showing multiple sign stand bases stacked one on top of another.
Figure 7:
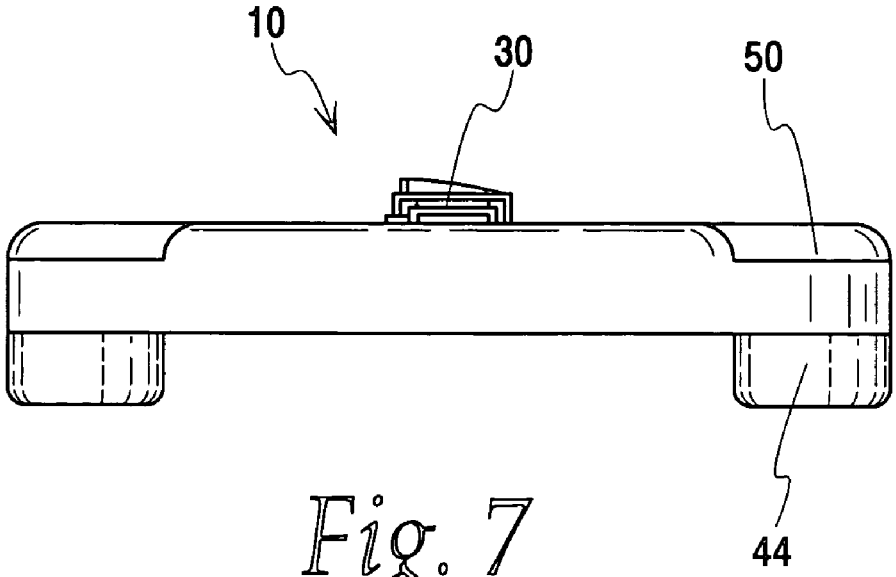
FIG. 7 is an end view of the sign stand base.
Figure 9:
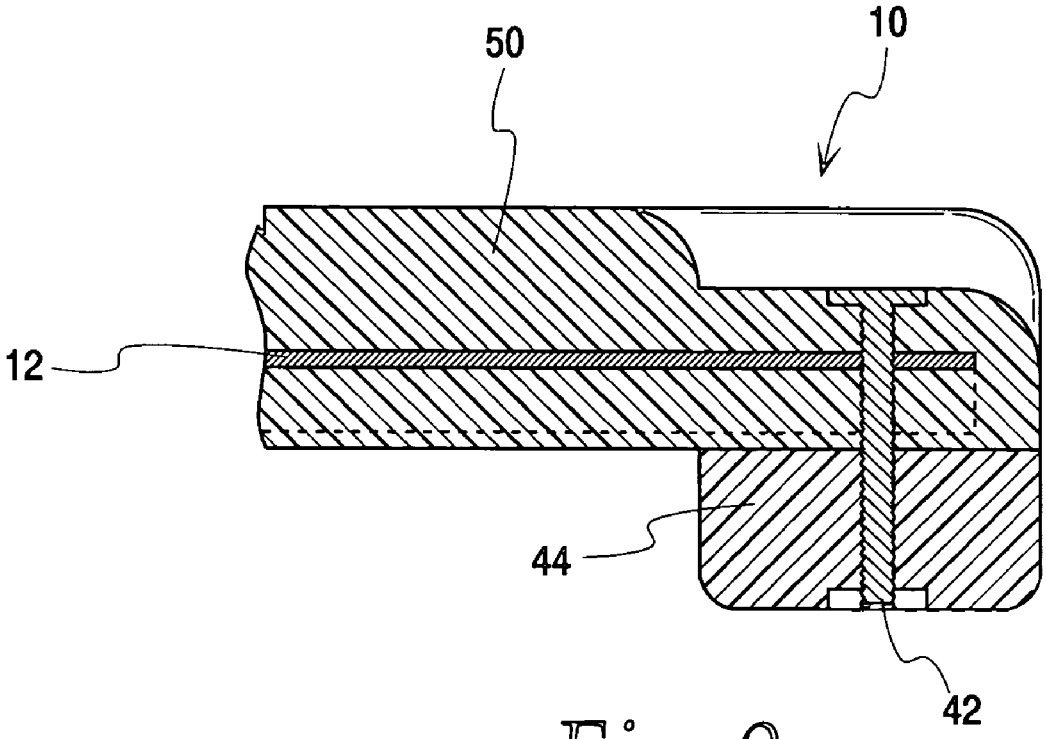
FIG. 9 is a fragmentary cross-sectional view taken along the line 9-9 of FIG. 3.

Referring to FIGS. 16 and 5, threaded fasteners 42 engage the free ends of leg pairs 12 and provide attachment for disk-like feet 44 to complete the sign stand base assembly. The threaded fasteners 42 are preferably recessed below corner pockets 51 formed in elastomeric body 50 (see for example FIGS. 1 and 2). As shown in FIG. 6, the corner recesses 51 provide nesting interlocking with rubber feet 44 as multiple sign stand bases are stacked one on top of another. With reference to FIG. 2, a tongue shaped recessed 54 is formed in the upper surface of elastomeric body 50 to partially receive adapter 30 which is lowered to its storage position as indicated for example in FIGS. 1 and 6. With reference to FIG. 6, stacking of multiple sign stand bases is facilitated in part by recess 54 which receives the bottom portion of a stored adapter 30 and the height of feet 44 which allows the adapter 30 of one sign stand base to clear the underside surface of an overlying elastomeric body of an adjacent sign stand base. Installation of rubber feet 44 with threaded fasteners 42 is further illustrated in the fragmentary cross-sectional view of FIG. 9.

Figure 15:
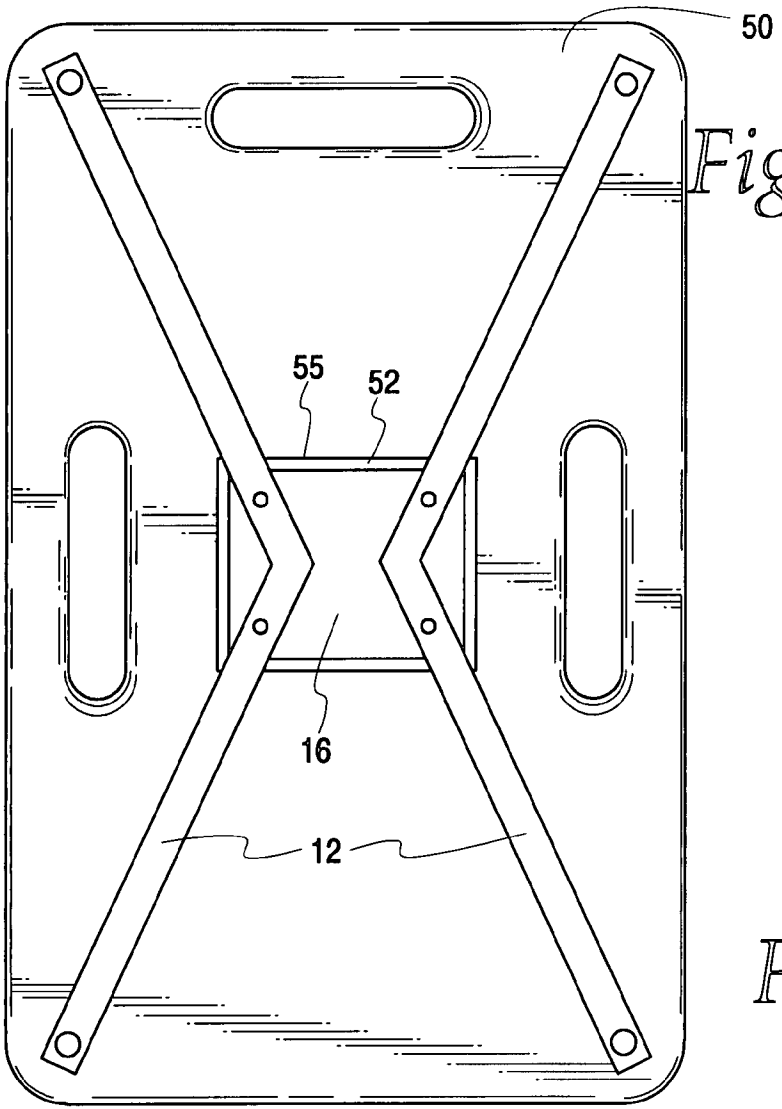
FIG. 15 is a top plan view of the rubber molding.
Figure 17:
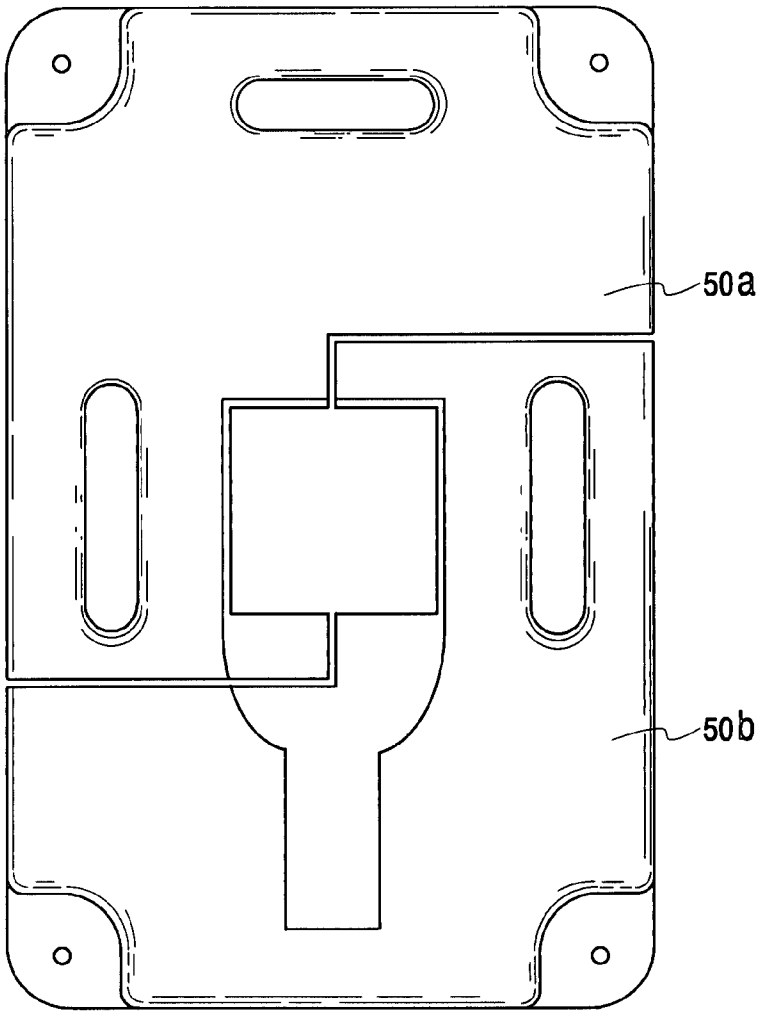
FIGS. 17 and 18 show alternative embodiments of the rubber molding.
Figure 18:
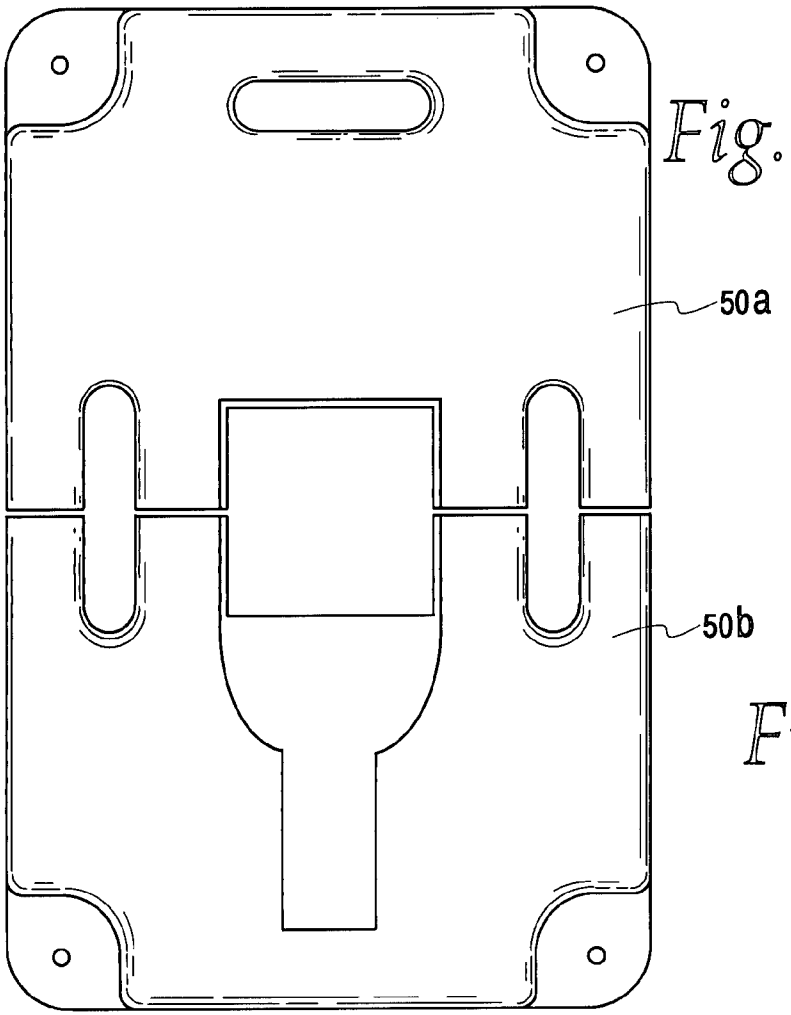

Referring to FIGS. 8 and 15, elastomeric body 50 is preferably manufactured using conventional crumb rubber compression techniques. The elastomeric body is molded with the hand holes, central opening and recesses indicated in the Figures, preferably as a single monolithic unit. With reference to FIGS. 17 and 18, the elastomeric body 50 may be molded in two separate complementary parts 50*a*, 50*b*. As can be seen in FIG. 17, the parting lines between the two halves of the elastomeric body pass through a pair of hand holes whereas in the arrangement of FIG. 18, the hand holes lie outside of the parting lines.

Referring to FIGS. 2 and 5, a sign mast and panel (not shown) are attached to adapter 30 with the adapter in the upright position indicated in FIG. 2. Wind loads are transmitted to adapter 30 and through fitting 18 to plate 16. The wind loadings are thereafter transferred along the legs, which radiate outwardly from force accumulating and distributing plate 16, extending to the corners of the sign stand base. The transmission of wind loadings to the internal framework structure is made efficient by the rigid joinder (via welding or other metallurgical joinder or bolted connections) of the internal framework components. With reference to FIG. 5, the wind loadings are transmitted ultimately to the feet located at corners of the sign stand base. With sign stand bases constructed according to principles of the present invention; loadings from the sign panel are routed through internal framework structural members rather than the elastomeric body.

With regard to performance of the sign stand base under applied wind loadings, the elastomeric body provides ballast for the internal framework structure, applying a downward force to the rigidly connected legs and feet. The ballast force provided by the elastomeric body continues to be applied to the load-carrying members despite vibration, movement or magnitude of force applied to the load bearing members. The elastomeric body 50 provides further advantages for storage and handling, as pointed out above. If desired, the internal framework structure and elastomeric body could be shipped separately and assembled at the point of use, using simple tools and assembly techniques. A certain flexibility in design is also possible with sign stand bases according to principles of the present invention. For example, different elastomeric bodies can be constructed of different materials and fillers to provide a different ballast weight for the internal structural framework.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

We claim:

1. A sign stand base, comprising:

a plate;

an adapter member upstanding from said plate, with a mast joinder for joining to a sign mast;

a plurality of legs outwardly radiating from said plate in generally horizontal directions and having free ends remote from said plate;

a resilient body defining an aperture for receiving said adapter member and said plate, and a plurality of recessed channels for receiving said plurality of legs;

rigid connections rigidly connecting said adapter member to said plate, said plate to said plurality of legs, and said plurality of legs to said resilient body; and said aperture dimensioned to form a gap between said resilient body and said plate and said adapter member, so that forces applied to said adapter member are transmitted through said plate to the free ends of said legs.

2. The sign stand base of claim 1 wherein said resilient body comprises a one piece monolithic molding of elastomeric material.

3. The sign stand base of claim 1 wherein said resilient body comprises a one piece monolithic molding of crumb rubber material.

4. The sign stand base of claim 1 wherein said resilient body has opposed upper and lower surfaces and said recessed channels extend from the lower surface.

5. The sign stand base of claim 1 wherein said plurality of legs comprise pairs of individual legs joined end to end to form a V-shaped subassembly.

6. The sign stand base of claim 5 wherein said pairs of individual legs are spaced apart, one from the other.

7. The sign stand base of claim 1 wherein said legs have an L-shaped cross section.

8. The sign stand base of claim 1 wherein said rigid connections rigidly connecting said adapter member to said plate, and said plate to said plurality of legs comprise metallurgical connections.

9. The sign base of claim 8 wherein said rigid connections rigidly connecting said plurality of legs to said resilient body comprise threaded fasteners.

10. The sign stand base of claim 1 wherein said mast joinder comprises a receptacle for receiving one end of a sign mast.

11. A sign stand assembly for supporting a sign panel, comprising:

a sign mast for supporting the sign panel and having a free end;

a plate;

an adapter member upstanding from said plate, with a mast joinder for joining to said sign mast;

a plurality of legs outwardly radiating from said plate in generally horizontal directions and having free ends remote from said plate;

a resilient body defining an aperture for receiving said adapter member and said plate, and a plurality of recessed channels for receiving said plurality of legs;

rigid connections rigidly connecting said adapter member to said plate, said plate to said plurality of legs, and said plurality of legs to said resilient body; and said aperture dimensioned to form a gap between said resilient body and said plate and said adapter member, so that forces applied to said adapter member are transmitted through said plate to the free ends of said legs.

12. The sign stand base of claim 11 wherein said resilient body comprises a one piece monolithic molding of elastomeric material.

13. The sign stand base of claim 11 wherein said resilient body comprises a one piece monolithic molding of crumb rubber material.

14. The sign stand base of claim 11 wherein said resilient body has opposed upper and lower surfaces and said recessed channels extend from the lower surface.

15. The sign stand base of claim 11 wherein said plurality of legs comprise pairs of individual legs joined end to end to form a V-shaped subassembly.

16. The sign stand base of claim 15 wherein said pairs of individual legs are spaced apart, one from the other.

17. The sign stand base of claim 11 wherein said legs have an L-shaped cross section.

18. The sign stand base of claim 11 wherein said rigid connections rigidly connecting said adapter member to said plate, and said plate to said plurality of legs comprise metallurgical connections.

19. The sign stand base of claim 18 wherein said rigid connections rigidly connecting said plurality of legs to said resilient body comprise threaded fasteners.

20. The sign stand base of claim 11 wherein said mast joinder comprises a receptacle for receiving one end of said sign mast.

* * * * *